US007988526B2

(12) United States Patent
Gransberry

(10) Patent No.: US 7,988,526 B2
(45) **Date of Patent: *Aug. 2, 2011**

(54) MODESTY FOAM PAD AND BRASSIERE MADE

(75) Inventor: Leslie Gransberry, Westport, CT (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/729,725

(22) Filed: Mar. 23, 2010

(65) Prior Publication Data

US 2010/0233936 A1 Sep. 16, 2010

Related U.S. Application Data

(63) Continuation of application No. 11/725,068, filed on Mar. 16, 2007, now Pat. No. 7,727,048.

(51) Int. Cl.
*A41C 3/00* (2006.01)

(52) U.S. Cl. ..... 450/39; 450/37; 450/57; 450/58

(58) Field of Classification Search ..... 450/37–39, 450/54–58, 36; 2/267, 268; 623/7, 8; 604/385.07, 604/74

See application file for complete search history.

(56) References Cited

U.S. PATENT DOCUMENTS

| | | | |
|---|---|---|---|
| 3,021,844 | A | 2/1962 | Flagg et al. |
| 3,021,845 | A | 2/1962 | Smith |
| 3,101,717 | A | 8/1963 | Korman |
| 3,187,753 | A | 6/1965 | Angelo |
| 4,333,471 | A | 6/1982 | Nakai |
| 4,372,321 | A | 2/1983 | Robinson |
| 4,481,951 | A | 11/1984 | Cole et al. |
| 4,557,267 | A | 12/1985 | Cole |
| 4,640,288 | A | 2/1987 | Hattori |
| 4,674,131 | A | 6/1987 | Broel |
| 5,154,659 | A | 10/1992 | Gluckin |
| 5,683,286 | A | 11/1997 | Kielland |
| 6,083,080 | A | 7/2000 | Lawson et al. |
| 6,213,841 | B1 | 4/2001 | Kuo |
| 6,283,820 | B1 | 9/2001 | Huang |
| 6,306,006 | B1 | 10/2001 | Cheng |
| 6,350,175 | B2 | 2/2002 | Johnson et al. |
| 6,398,620 | B1 | 6/2002 | Huang |
| 6,406,352 | B1 | 6/2002 | Cheng |
| 6,743,073 | B1 | 6/2004 | Tsai et al. |
| 6,857,935 | B1 | 2/2005 | Dohan |

(Continued)

FOREIGN PATENT DOCUMENTS

| | | | |
|---|---|---|---|
| FR | 990244 | A | 9/1951 |

(Continued)

*Primary Examiner* — Gloria Hale
(74) *Attorney, Agent, or Firm* — Womble Carlyle Sandridge & Rice, PLLC

(57) ABSTRACT

A pad for a brassiere having a foam layer; a liner layer and a shaped cover positioned between the foam layer and the liner layer is provided. The shaped cover is positioned between the foam layer and the liner layer to provide enhanced coverage to the brassiere. A brassiere having a pair of breast-receiving cups is provided. Each of the pair of breast-receiving cups has a pad having a foam layer, a liner layer, and a shaped cover positioned between the foam layer and the liner layer. The shaped cover is positioned between the foam layer and the said liner layer to provide enhanced coverage to the brassiere.

19 Claims, 5 Drawing Sheets

U.S. PATENT DOCUMENTS

| | | | | |
|---|---|---|---|---|
| 6,881,123 | B1 | 4/2005 | Klakauskas | |
| 6,997,775 | B2 | 2/2006 | Jagaric et al. | |
| 7,081,034 | B1 | 7/2006 | Zoellner | |
| 7,214,121 | B1 | 5/2007 | Huang | |
| 7,727,048 | B2 * | 6/2010 | Gransberry | 450/39 |
| 7,815,488 | B2 * | 10/2010 | Gransberry | 450/39 |
| 2005/0037689 | A1 | 2/2005 | Gorski et al. | |
| 2006/0057938 | A1 | 3/2006 | Huang | |
| 2006/0089084 | A1 | 4/2006 | Dohan | |
| 2006/0141905 | A1 | 6/2006 | Lau | |

FOREIGN PATENT DOCUMENTS

| | | | |
|---|---|---|---|
| FR | 2870681 | A3 | 12/2005 |
| WO | WO-03/105616 | A1 | 12/2003 |
| WO | WO-2004073433 | A2 | 9/2004 |
| WO | WO-2005094426 | A2 | 10/2005 |

* cited by examiner

MODESTY FOAM PAD AND BRASSIERE MADE

CROSS-REFERENCE TO RELATED APPLICATIONS

This application is a continuation of U.S. patent application Ser. No. 11/725,068, filed Mar. 16, 2007, now U.S. Pat. No. 7,727,048.

BACKGROUND OF THE INVENTION

1. Field of the Invention

This invention relates to a foam pad for a brassiere that offers modesty to the wearer and a brassiere using such a pad. More particularly, the invention relates to a foam pad for a brassiere that has a cover located at the apex to offer modesty to the wearer, and the brassiere made using such a pad.

2. Description of Related Art

Conventional brassieres for everyday wear should offer comfort as well as coverage to the wearer. Consumers want to feel comfortable when wearing lightweight clothes yet confident that their undergarments, specifically brassieres, are providing adequate coverage. Brassieres that are too sheer and thin are not likely to provide the wearer with the desired level of modesty and discretion. At the other extreme, foam brassieres that are thick and offer modesty are often excessively padded, thus uncomfortable and hide the wearer's natural shaping.

Accordingly, there is a need for a pad for a brassiere and a brassiere that offers modesty with lightweight padding and optimal comfort.

SUMMARY OF THE INVENTION

The present invention further provides for a brassiere that offers modesty to the wearer with lightweight padding.

The present invention also provides for a foam pad for a brassiere that incorporates a region of additional coverage at the apex of the pad for modesty.

The present invention further provides for a brassiere that offers modesty to the wearer with lightweight padding.

The present invention yet further provides for a foam pad for a brassiere that incorporates a fabric region that covers the apex of the pad.

The present invention yet still further provides for a foam pad for a brassiere that incorporates a centrally located fabric region to cover a protuberance of the breast of the wearer to offer optimal modesty.

The present invention still yet further provides for a foam pad for a brassiere that incorporates a decoratively shaped fabric region that covers the apex of the pad.

The present invention provides for a foam pad for a brassiere that incorporates a centrally located decoratively shaped fabric region to cover a protuberance or feature of the breast and offers optimal modesty and a brassiere that incorporates such a fabric region.

The present invention provides for a brassiere that incorporates a pair of foam pads, each of the pads having a fabric region that covers the apex of a respective cup of the brassiere, the fabric region not being visible from the outside of the facing surface of the brassiere or beneath clothing.

A pad for a brassiere having a foam layer, a liner layer and a shaped cover positioned between the foam layer and said liner layer is provided. The shaped cover is positioned between the foam layer and the liner layer to provide enhanced coverage to the brassiere.

A brassiere having a pair of breast-receiving cups is provided. Each of the pair of breast-receiving cups has a pad having a foam layer, a liner layer, and a shaped cover positioned between said foam layer and the liner layer. The shaped cover is positioned between said foam layer and the said liner layer to provide enhanced coverage to the brassiere.

BRIEF DESCRIPTION OF THE DRAWINGS

These and further objects, advantages and features of the invention will be understood by reference to the following specification in conjunction with the accompanying drawings, in which like reference characters denote like elements of structure and.

DETAILED DESCRIPTION OF THE DRAWINGS

Figure 1:
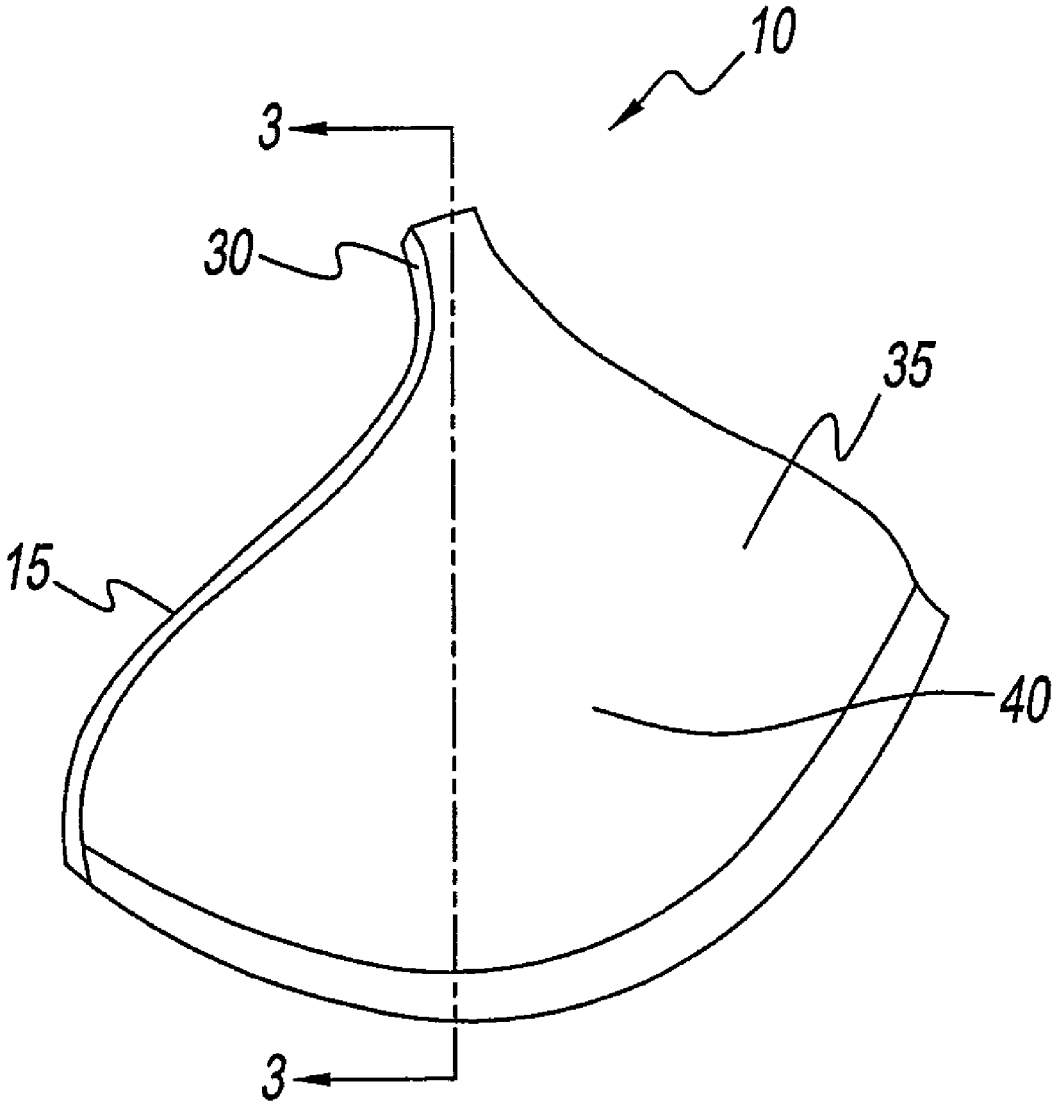
FIG. 1 illustrates a perspective view of the foam pad of the present invention.

In reference to the drawings and, in particular, to FIG. 1, there is illustrated a brassiere pad generally represented by reference numeral 10. The brassiere pad 10 is a molded multilayer pad. Pad 10 has an inner layer 15 at a concave surface or inner surface of pad 10. Pad 10 has an outer layer 35 at a convex layer or surface of pad 10. Between inner layer 15 and outer layer 35 is a foam layer 30. Foam layer 30 has a degree of thickness to provide a light degree of coverage and loft when placed in a brassiere. Pad 10 has an apex 40 centrally located at mid portion of pad 10. While pad 10 has a generally uniform thickness, regions of differing thicknesses could also be used in pad 10 to offer different effects to the wearer.

Figure 2:
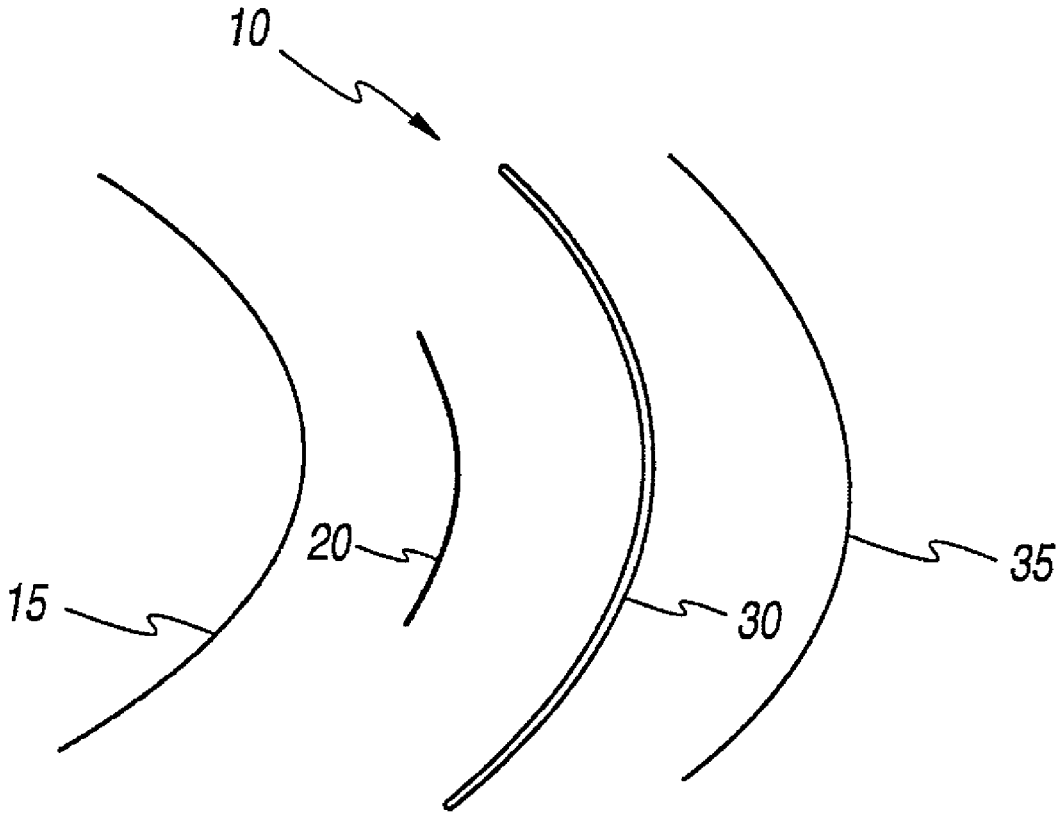
FIG. 2 illustrates an exploded view of the foam pad of FIG. 1 of the present invention.

Referring to FIG. 2, pad 10 is shown in an exploded view. Between inner layer 15 and foam layer 30 is a fourth layer or cover 20. Cover 20 has a smaller surface than layers 15, 30 or 35. Cover 20 is centrally located over apex 40 of pad 10. When pad 10 is fitted within a brassiere, cover 20 is coincident with apex 40 of the brassiere to offer complete coverage and modesty to the wearer. While cover 20 is shown coincident with the apex 40, on a different style of brassiere, for example balconette or demi cup brassieres, cover 20 would be coincident with the desired anatomical feature to provide optimal concealment and modesty.

Figure 3:
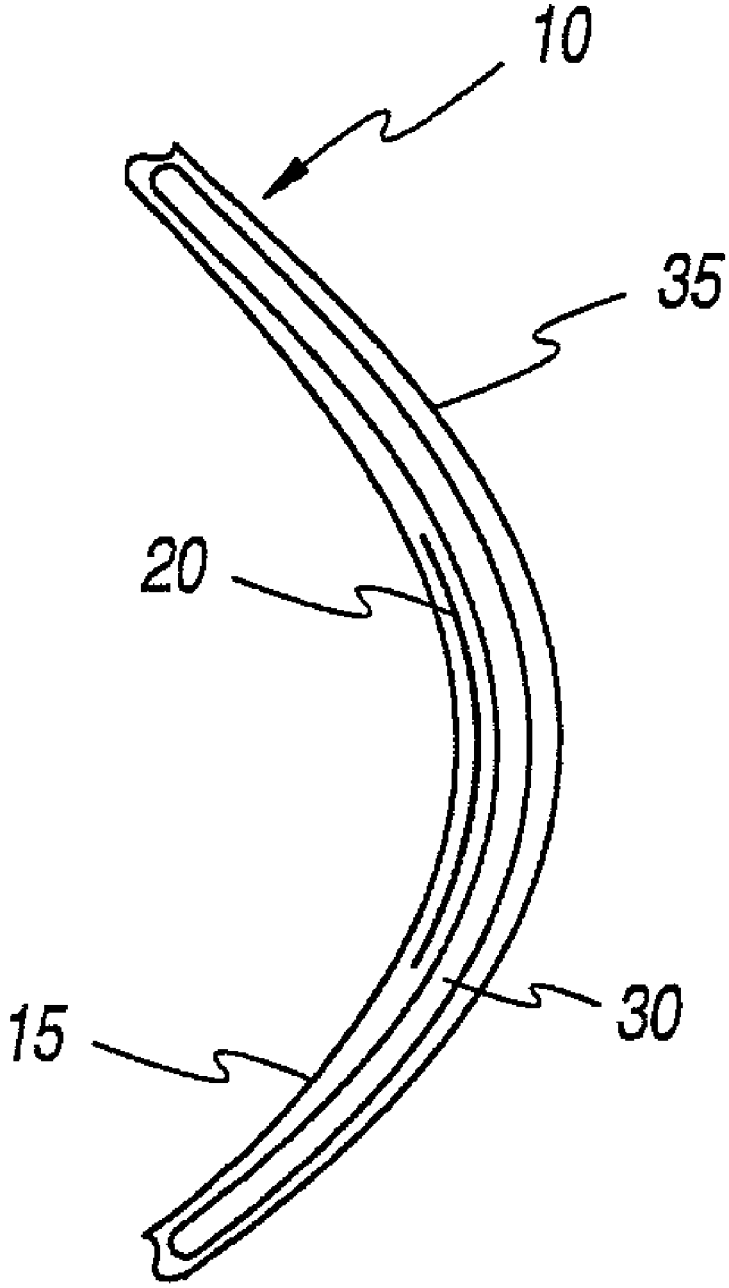
FIG. 3 illustrates a cross-sectional view of the pad of the present invention, along line 3.

Pad 10 is a thin low to medium coverage pad, as shown in FIG. 3. Typically such pads, when placed in a brassiere will not provide substantial modesty to the wearer when thin or revealing outer clothes are worn. However, cover 20, of the present invention is centrally located to ensure that despite the minimal thickness of pad 10, that adequate coverage is provided. Were cover 20 not present between layers 15 and 30, the wearer's modesty would not be preserved and undesired exposure would be visible through the outer clothing. When pad 10 is incorporated into a brassiere of the present invention, a minimally padded brassiere that provides full modesty and coverage is provided. Such a brassiere incorporating pad 10 eliminates the need to wear a heavily padded brassiere to achieve full modesty.

Figure 5:
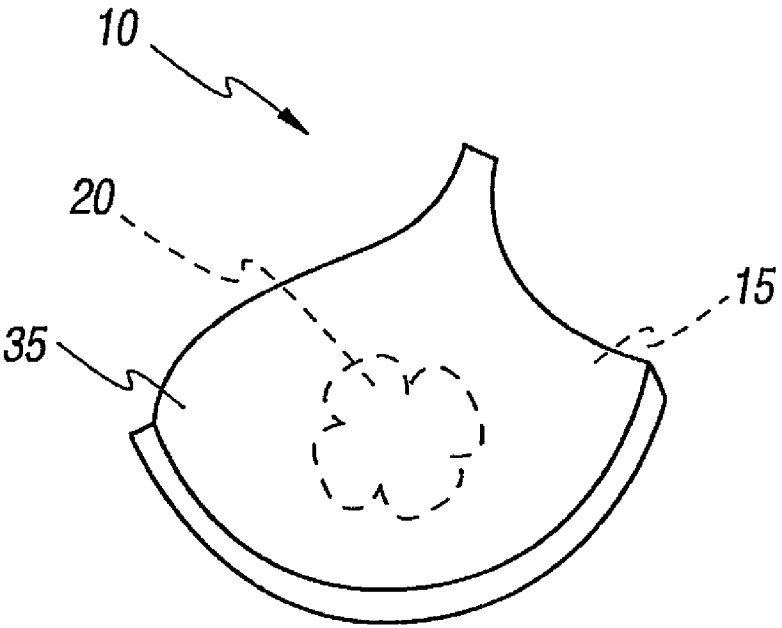
FIG. 5 illustrates a front view of the pad of the present invention showing the hidden lines of the cover.
Figure 4:
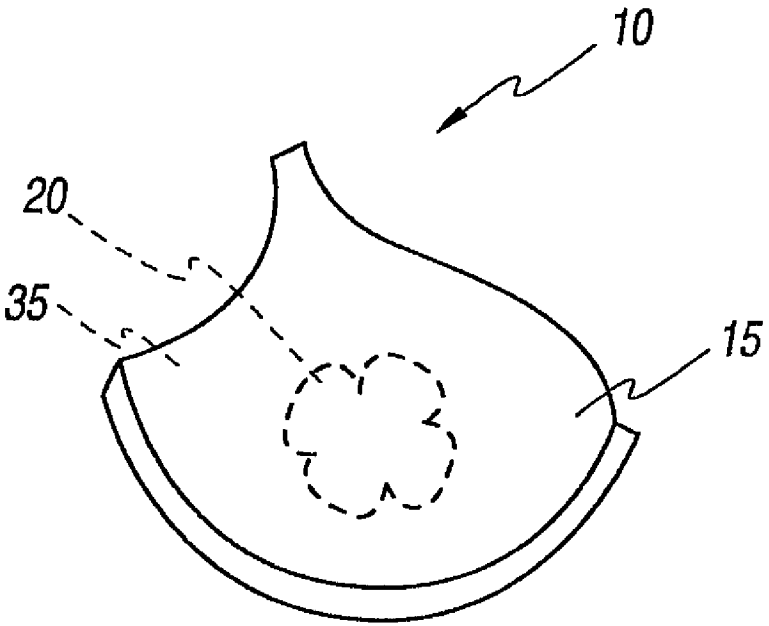
FIG. 4 illustrates a rear view of the pad of the present invention showing the relief of the inner surface of the pad.

Referring to FIGS. 2, 4 and 5, cover 20 is located between layer 15 and foam layer 30, to ensure invisibility beneath outer clothing. Foam layer 30 acts as a buffer to prevent any possible relief or visibility of the cover beneath clothing. Were cover 20 between foam layer 30 and outer layer 35, cover 20 would possibly be visible through outer layer 35 and beneath clothing. While cover 20 is invisible from outer layer 35, it is visible through concave layer 15 in relief.

Cover 20 is preferably a layer of material, such as, nylon, although other materials such as polyester or cotton that have a smooth surface when molded/laminated between inner layer 15 and foam layer 30, could also be used. Similarly, a laminated package of a combination of materials that have a smooth surface when molded, could also be used. Cover 20 is preferably made of any material or combination of materials that easily drapes or conforms during the lamination and molding processes. Layer 15 is made from a material such as polyester, nylon, cotton blend or a rayon blend or any other material that is easily molded. Layer 35 is made from the same or similar material as layer that is easily molded. Layer 30 is a layer of foam, preferably polyurethane foam, or any other similar material that is easily molded and laminated and capable of withstanding heat and numerous washings.

Referring to FIG. 4, the concave or inner surface of pad 10 is shown. Cover 20 is shown and shaped as a flower. While cover 20 has a decorative shape, the shape is also functional. The flower shape permits cover 20 to more easily conform to the shape of the apex compared to other shapes. For example, a purely circular shaped cover, if made from a stiff material, would tend to have puckers or ripples at its edges when it is molded at the apex of the pad. A circular shape of a supple material would provide proper draping. Other shapes that would also be functional as well as decorative are a clover, a star or a sunburst. As shown in FIG. 5, the outer surface of pad 10 does not show the relief of cover 20.

Figure 6:
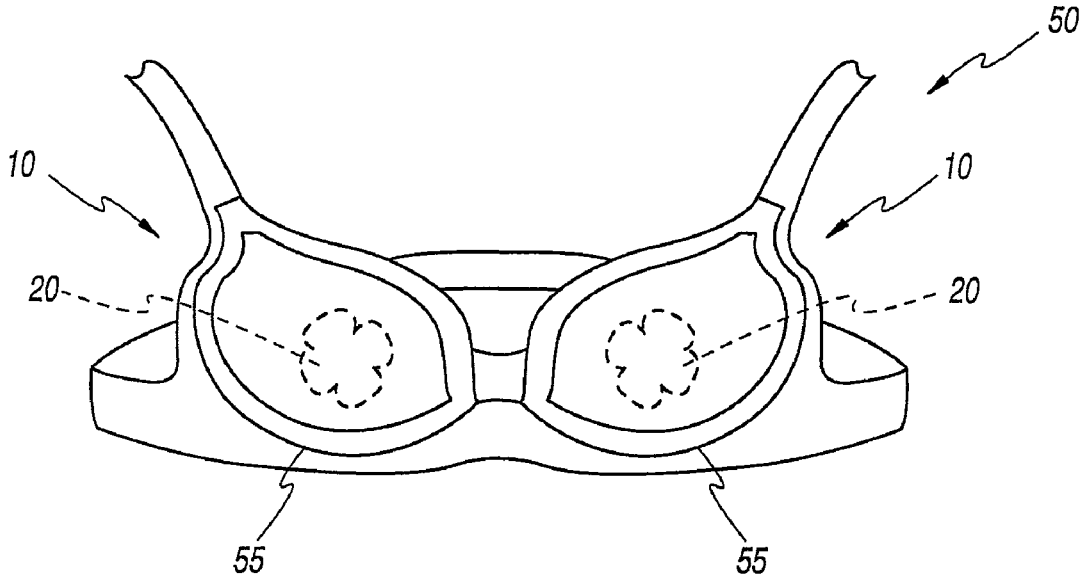
FIG. 6 illustrates a brassiere incorporating the pad of the present invention.

FIG. 6 shows a brassiere 50 that incorporates the pad 10 at cups 55. Brassiere 50 is shown as a softcup brassiere; however, pad 10 of the present invention can be incorporated into an underwire, a strapless brassiere, a sports brassiere, or a demi-cup brassiere, for example. Brassiere 50, when worn, offers the wearer the convenience and comfort of a lightweight brassiere and with the confidence and modesty of a heavily padded brassiere. Cover 20 generally has a smaller surface area than inner liner layer 15, foam layer 30 and outer layer 35. By having a smaller surface area than the other layers of pad 10, brassiere 50 offers a low padded brassiere that provides full modesty and coverage.

While the present disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the disclosure.

The invention claimed is:

1. A pad for a brassiere, comprising:

a molded pad shaped to comprise an apex, including:

a foam layer having a peripheral edge and a smooth outer surface;

an inner liner layer having a peripheral edge;

a shaped cover having a peripheral edge and an outer surface and positioned between said foam layer and said inner liner layer, the peripheral edges of the foam layer and the inner liner layer extending outwardly beyond the entire peripheral edge of the shaped cover; and when worn said shaped cover conceals a nipple of a wearer's breast, and the foam layer is selected to prevent visibility of the shaped cover from the outside.

2. The pad according to claim 1, further comprising an outer layer, said outer layer disposed over said foam layer.

3. The pad according to claim 2, wherein said outer layer is selected from a material selected from the group consisting of polyester, nylon, cotton, rayon and blends thereof.

4. The pad according to claim 1, wherein said shaped cover comprises a material selected from the group consisting of nylon, polyester, cotton, and blends thereof.

5. The pad according to claim 1, wherein said shaped cover has a decorative shape selected from the group consisting of a clover, a flower, a star and a sunburst.

6. The pad according to claim 1, wherein said foam layer is polyurethane foam.

7. The pad according to claim 2, wherein said foam layer, said outer layer, said liner layer and said shaped cover are molded to form a cup.

8. A pad for a brassiere comprising:

a molded multiple layer laminated pad having a peripheral edge and a smooth outer surface;

wherein one of said multiple layers is a shaped cover having a peripheral edge and an outer surface, the peripheral edges of other layers extending outwardly beyond the entire peripheral edge of the shaped cover, a nipple of the breast being concealed when said brassiere is worn, and the shaped cover is not visible when viewed from the outside.

9. The pad according to claim 8, wherein the pad comprises a liner layer on one side of said shaped cover and a foam layer on the other side of said shaped cover.

10. The pad according to claim 9, further comprising a fabric layer covering said foam layer.

11. The pad according to claim 10, wherein said fabric layer is selected from a material selected from the group consisting of polyester, nylon, cotton, rayon and blends thereof.

12. The pad according to claim 8, wherein said shaped cover comprises a material selected from the group consisting of nylon, polyester, cotton and blends thereof.

13. The pad according to claim 8, wherein said shaped cover has a decorative shape selected from the group consisting of a clover, a flower, a star and a sunburst.

14. The pad according to claim 9, wherein said foam layer is polyurethane foam.

15. A brassiere comprising:

a pair of breast-receiving cups, a pair of shoulder straps and a pair of side panels, one of said pair of shoulder straps and one of said pair of side panels connected to one of said pair of breast receiving cups, the other of said pair of shoulder straps and the other of said pair of side panels associated with the other of said pair of breast-receiving cups, each of said pair of breast-receiving cups comprises:

an outer layer having a peripheral edge and a smooth outer surface;

a foam layer having a peripheral edge;

an inner liner layer having a peripheral edge; and a shaped cover having a peripheral edge and an outer surface and positioned between said foam layer and said inner liner layer, the peripheral edges of the outer layer, foam layer, and inner liner layer extending outwardly beyond the entire peripheral edge of the shaped cover;

when worn said shaped cover conceals a nipple of a wearer's breast, and the foam layer is selected to prevent visibility of the shaped cover from the outside.

16. The brassiere according to claim 15, wherein said outer layer is selected from a material selected from the group consisting of polyester, nylon, cotton, and blends thereof.

17. The brassiere according to claim 15, wherein said shaped cover is made from a material selected from the group consisting of nylon, polyester, cotton and blends thereof.

18. The brassiere according to claim 15, wherein said shaped cover has a decorative shape selected from the group consisting of a clover, a flower, a star and a sunburst.

19. The brassiere according to claim 15, wherein said foam layer is polyurethane foam.

* * * * *